US006048251A

United States Patent [19]

Klitsner et al.

[11] Patent Number: 6,048,251

[45] Date of Patent: Apr. 11, 2000

[54] FLIP OVER TOY

[75] Inventors: Daniel Klitsner, Larkspur, Calif.; Charles W. Bookstaver, Columbus, Miss.; Brian Clemens, San Francisco, Calif.

[73] Assignee: F. F. Acquisition Corp., West Point, Mich.

[21] Appl. No.: 09/020,125

[22] Filed: Feb. 6, 1998

[51] Int. Cl.[7] ..... A63H 3/52

[52] U.S. Cl. ..... 446/479; 446/76; 446/482; D21/519; D21/523; D21/524

[58] Field of Search ..... 446/71, 73, 76, 446/479, 481, 482, 474; D21/519, 522, 523, 524, 526; 434/347; 273/287, 241

[56] References Cited

U.S. PATENT DOCUMENTS

| | | | |
|---|---|---|---|
| D. 165,605 | 1/1952 | Page | D21/524 |
| D. 202,206 | 9/1965 | Horowitz | D21/521 |
| D. 204,399 | 4/1966 | Horowitz | D21/522 |
| D. 207,266 | 3/1967 | Blumenthal | D21/524 |
| 250,509 | 12/1881 | Durlach . | |
| D. 260,274 | 8/1981 | Appel et al. | D21/524 |
| D. 327,102 | 6/1992 | Martin | D21/512 |
| D. 344,107 | 2/1994 | Tse | D21/512 |
| D. 345,592 | 3/1994 | Houry et al. . | |
| D. 370,947 | 6/1996 | Pipik . | |
| 826,598 | 7/1906 | Nicolaus . | |
| 2,601,374 | 6/1952 | Ditzler et al. . | |
| 2,620,018 | 12/1952 | Pagano | 446/482 |
| 3,133,376 | 5/1964 | Orenstein . | |
| 4,338,741 | 7/1982 | Tsui et al. . | |
| 4,341,034 | 7/1982 | Tsui et al. . | |
| 4,552,362 | 11/1985 | Oake | 273/237 |
| 4,682,827 | 7/1987 | Woodward | 446/482 |
| 4,973,287 | 11/1990 | Martin . | |
| 4,992,068 | 2/1991 | Conrad | 446/85 |
| 5,004,445 | 4/1991 | Coleman et al. | 446/478 |
| 5,329,714 | 7/1994 | Lee | 446/267 |
| 5,564,960 | 10/1996 | Underhill, Jr. | 446/8 |

*Primary Examiner*—Robert A. Hafer
*Assistant Examiner*—Laura Fossum
*Attorney, Agent, or Firm*—Brinks Hofer Gilson & Lione

[57] ABSTRACT

A toy is provided in which a first entertaining environment is provided when the toy is in a first position and a second entertaining environment is provided when the toy is in a second position. The toy is transformed form the first position to the second position by rotating the toy from one side to another.

3 Claims, 7 Drawing Sheets

100
101
102
103
104
105
106
107
108
109

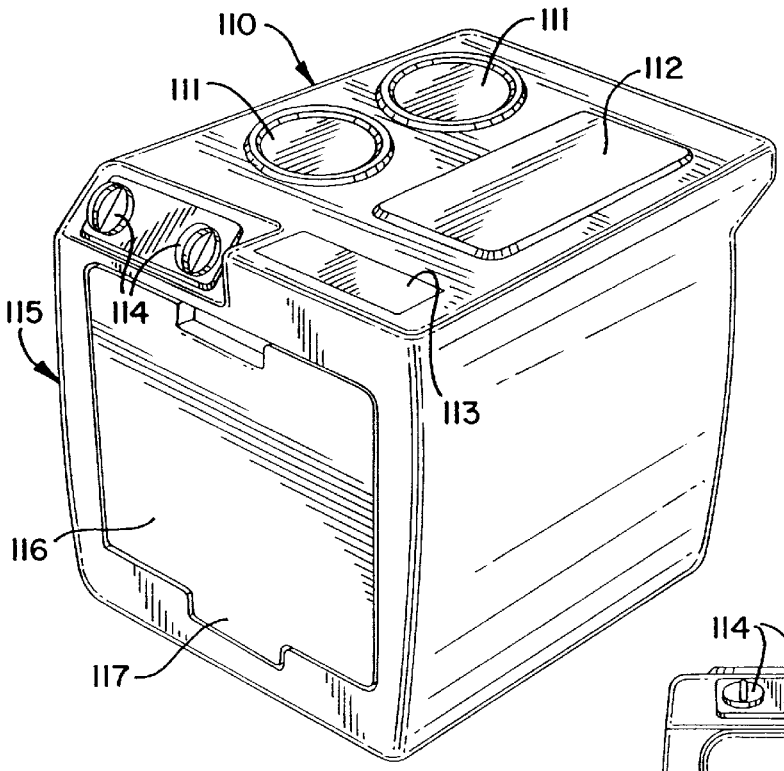
FIG. 5
FIG. 6
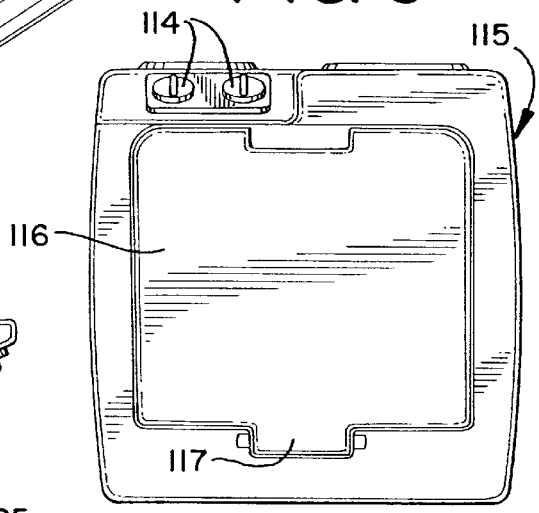
FIG. 7
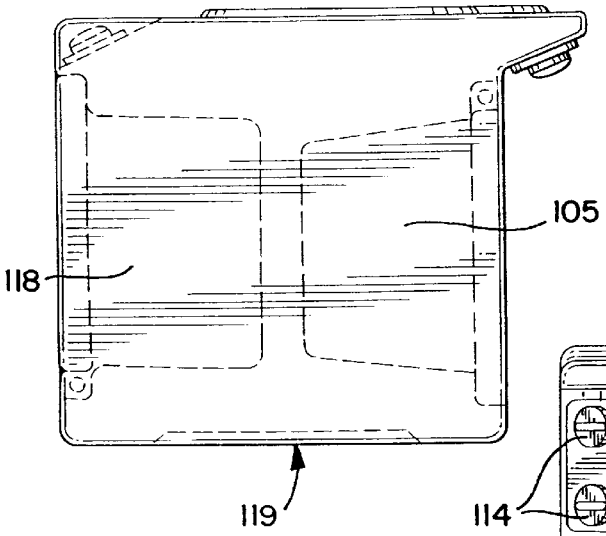
FIG. 8
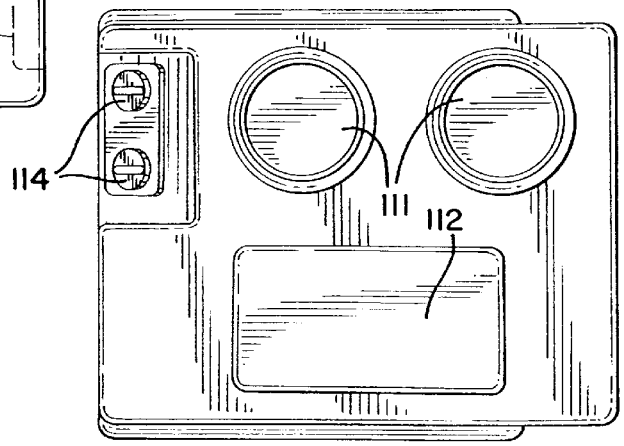

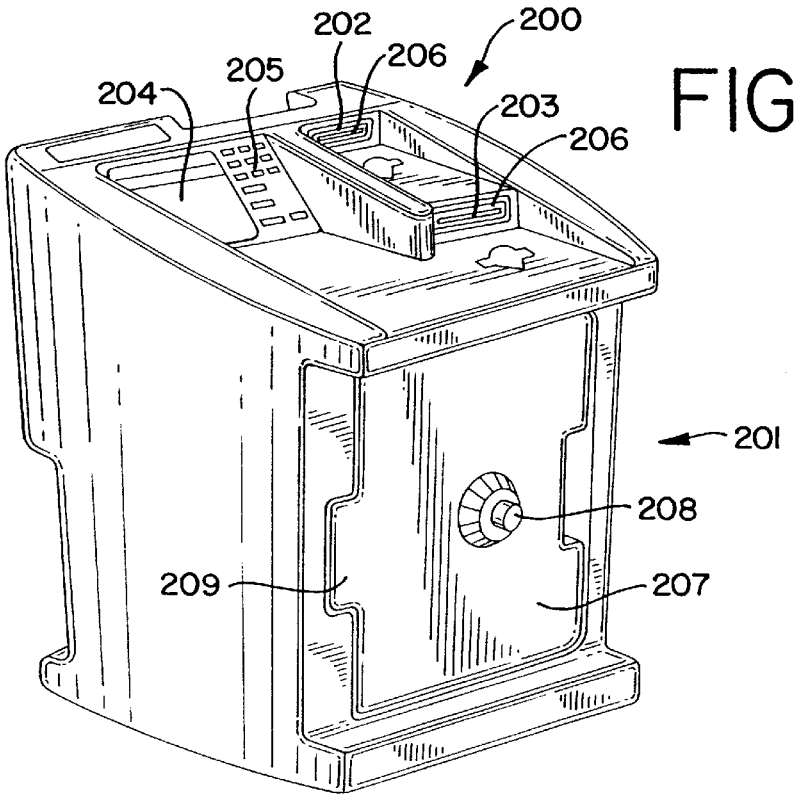
FIG. 10
FIG. 11
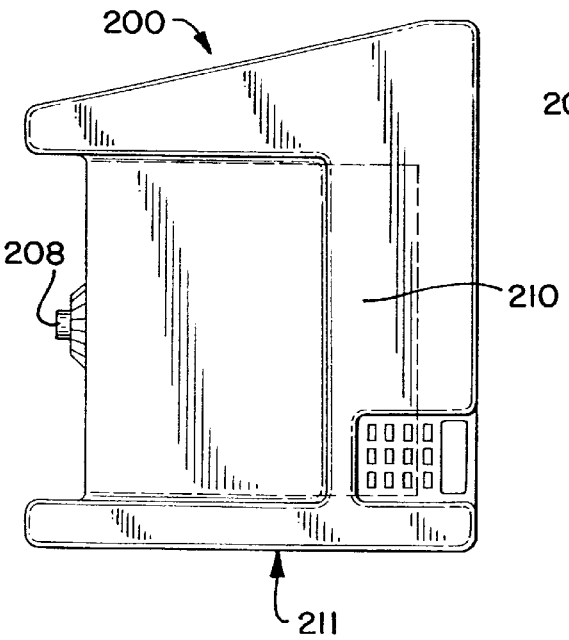
FIG. 12
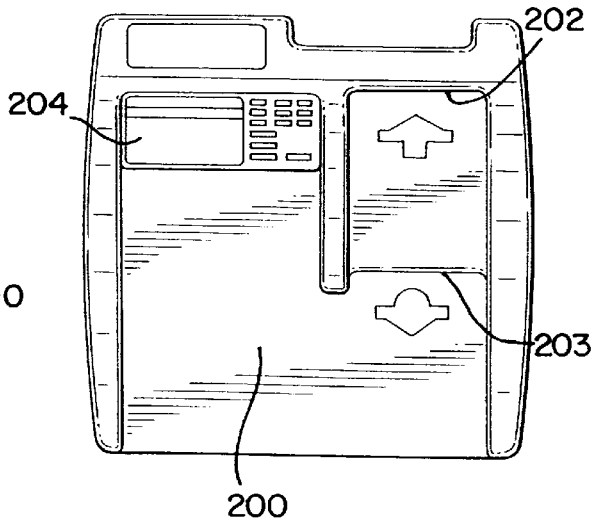

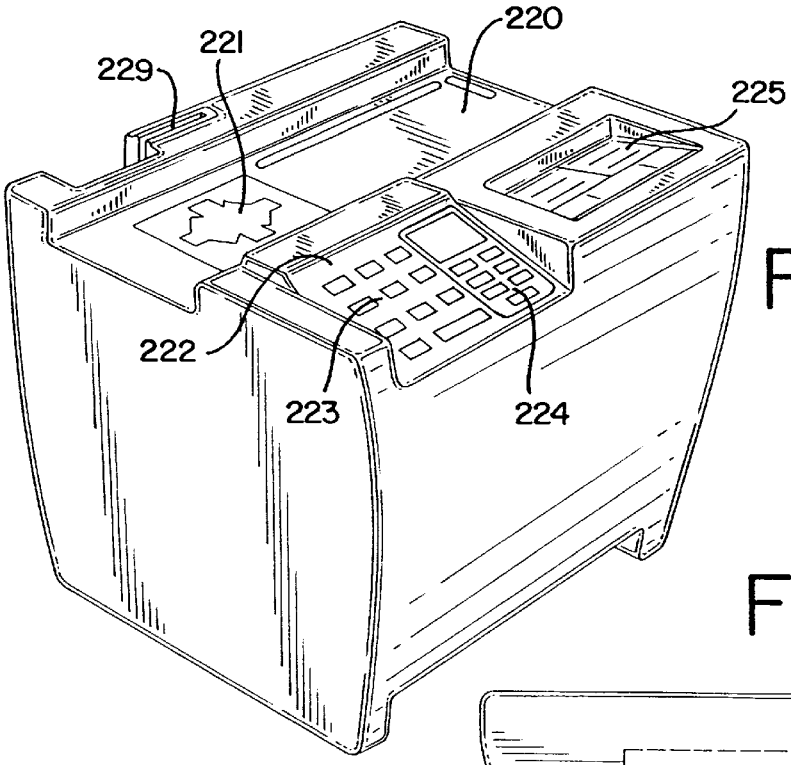
FIG. 13
FIG. 14
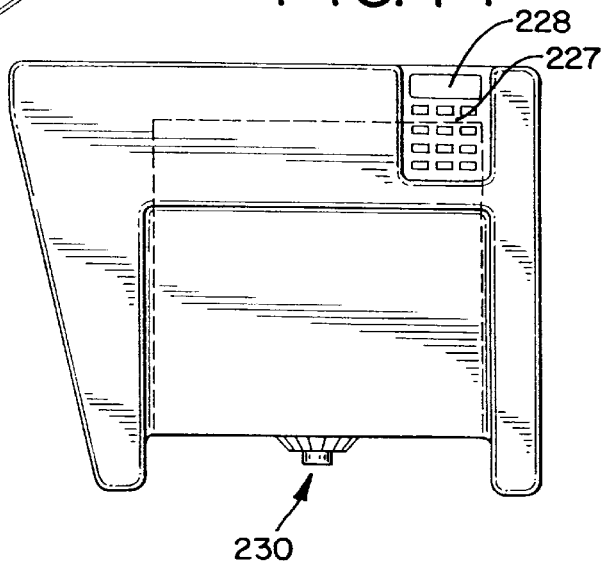
FIG. 15
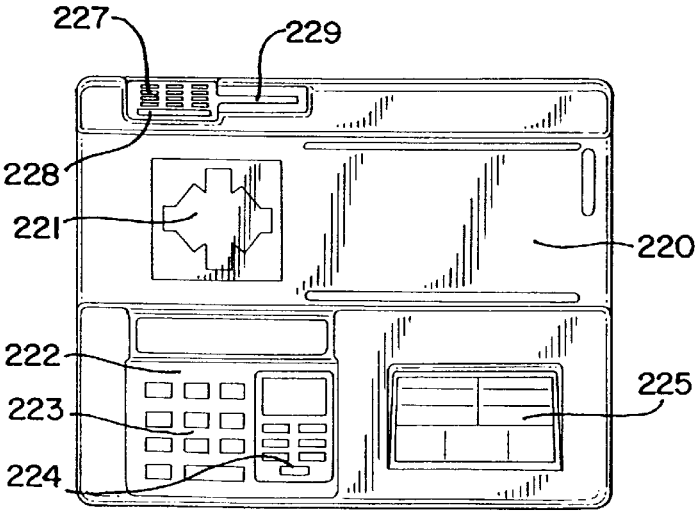

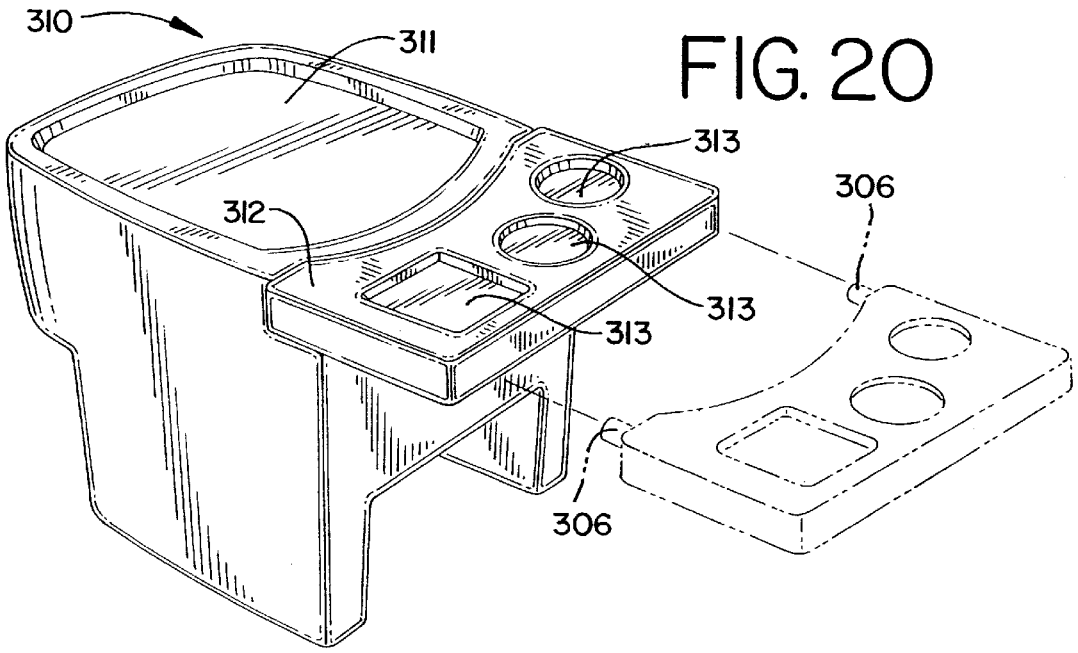
FIG. 20
FIG. 21
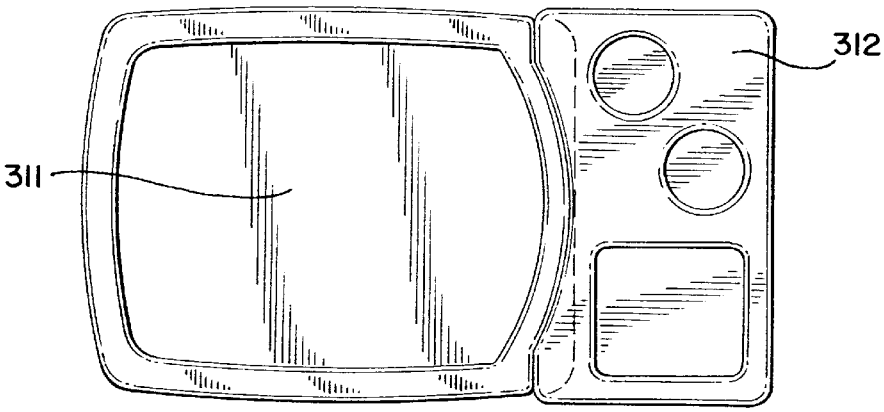
FIG. 22
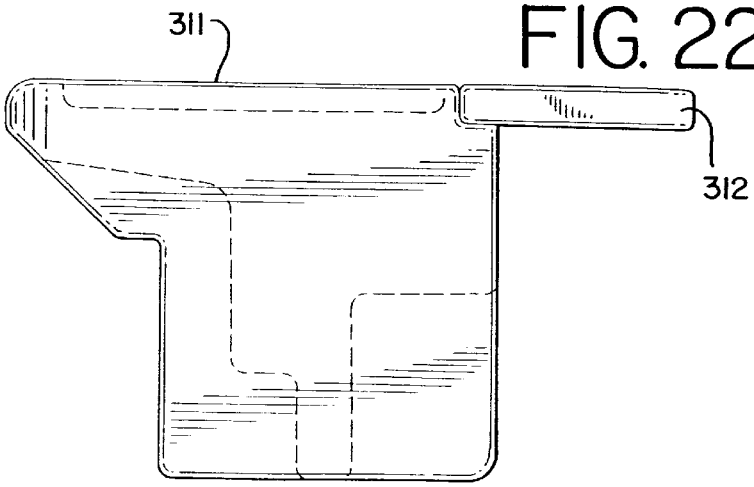

FLIP OVER TOY

BACKGROUND OF THE INVENTION

Children have unpredictable and short lived tastes in toys. As a result, toy manufacturers are constantly trying to keep up with trends and provide a wide and varied range of products and choices in an attempt to keep up with this rather fickle consumer.

Unfortunately, parents have limited finances and resources and are unable to continually provide new sources of entertainment by purchasing new toys. As the individual likes and dislikes of children come and go, parents often need to buy new toys for their children. This comes at no small expense. Moreover, it is far from certain how long a child will enjoy a particular toy, if they enjoy the toy at all, once it gets home.

There are many toys that are quite effective at entertaining children and that simulate enjoyable environments. For example, U.S. Pat. No. 4,973,287 to Martin is directed to a toy check out station. U.S. Pat. No. 4,341,034 to Tsui et al. discloses a toy washing machine and U.S. Pat. No. 4,388,741 to Tsui et al. discloses a toy clothes dryer. U.S. Pat. No. 3,133,376 to Orenstein is drawn to a toy electric range. U.S. Pat. No. Design 370,947 depicts a design for a toy play kitchen. Each of these toys is useful and entertaining; however, each of them embodies only a single use or a single simulated environment. These toys entertain a child only if the child is interested in the one particular use and only for as long as the child is interested in the one particular use.

Consequently, there is a need in the art for a low cost toy that stands a better chance of being accepted by a child and of entertaining the child for a significant period of time.

SUMMARY OF THE INVENTION

A toy is provided which comprises a first environment, a second environment, a first side and a second side. The first environment is enabled when the toy is supported on the first side, and the second environment is enabled when the toy is supported on the second side.

Similarly, a toy is also provided which comprises a hexahedron having a first base side, a second base side, a first amusement side and a second amusement side. The base sides are capable of supporting the toy in an upright position and the amusement sides have entertaining features. The first base side and first amusement side are located relative to each other such that the toy may be supported on its first base side and enable use of the first amusement side. The second base side and second amusement side are located relative to each other such that the toy may be supported on its second base side and enable use of the second amusement side.

BRIEF DESCRIPTION OF THE DRAWINGS

FIG. 5 is a right front perspective view of the toy of FIG. 1 showing the simulated stove and oven environment;

FIG. 6 is a front elevational view of the toy of FIG. 1 showing the simulated stove and oven environment;

FIG. 7 is a right side elevational view of the toy of FIG. 1 showing the simulated stove and oven environment;

FIG. 8 is a top plan view of the toy of FIG. 1 showing the simulated stove and oven environment;

FIG. 10 is a left front perspective view of a toy of a second embodiment of the invention, showing an automatic teller machine environment;

FIG. 11 is a right side elevational view of the toy of FIG. 10 showing the automatic teller machine environment;

FIG. 12 is a top plan view of the toy of FIG. 10 showing the automatic teller machine environment;

FIG. 13 is a perspective view of the toy of FIG. 10 showing a grocery check out lane environment;

FIG. 14 is a side elevational view of the toy of FIG. 10 showing the grocery check out lane environment;

FIG. 15 is a top plan view of the toy of FIG. 10 showing the grocery check out lane environment;

FIG. 20 is a perspective view of the toy of FIG. 16 showing an infant changing table and tray;

FIG. 21 is a top plan view of the toy of FIG. 16 showing the infant changing table and tray; and FIG. 22 is a side elevational view of the toy of FIG. 16 showing the infant changing table and tray.

DETAILED DESCRIPTION OF THE DRAWINGS AND PREFERRED EMBODIMENTS OF THE INVENTION

The present invention is directed to a toy with a plurality of sides. When the toy rests on one side, it simulates a first environment. The toy can also be rotated or flipped over so that it rests on a different side and simulates a second environment. Preferably, the first environment is displayed using two sides other than the side on which the toy rests. It is also preferred that one of the two sides used to simulate the first environment is the side on which the toy rests when displaying the second environment.

The toy may have any number of sides so long as there is a three-dimensional structure. A side is any surface of the toy that is (1) capable of supporting the toy, (2) capable of displaying an environment, or (3) a distinct and discernible surface of the toy. In the most preferred embodiment, the toy is a hexahedron.

When the toy of the present invention is supported on a particular side, an entertaining environment or particular amusement side is displayed. This environment or amusement side may be anything that is useful, amusing, entertaining or enjoyable to children. Children have a particular affinity to adult role-playing environments and enjoy doing the things that they see their parents do. Consequently, preferable environments relate to activities that children see their parent do such as laundry, cooking, shopping, stopping at the automatic teller machine, etc. Three of the most preferred embodiments are described below and shown in FIGS. 1–22.

Particular sides may be referred to by certain names, e.g. base side, amusement side. The name of a particular side is not fixed, but, rather, depends upon the orientation of the toy. For example, a side may be a base side in one position because it supports the toy; however, if the toy is rotated to permit use of another environment, that base side may become an amusement side. The status of a side is controlled by its function. In other words, any side that supports the toy is a base side and any side that has amusing features is an amusement side.

Figures 1, 2, 3, 4:
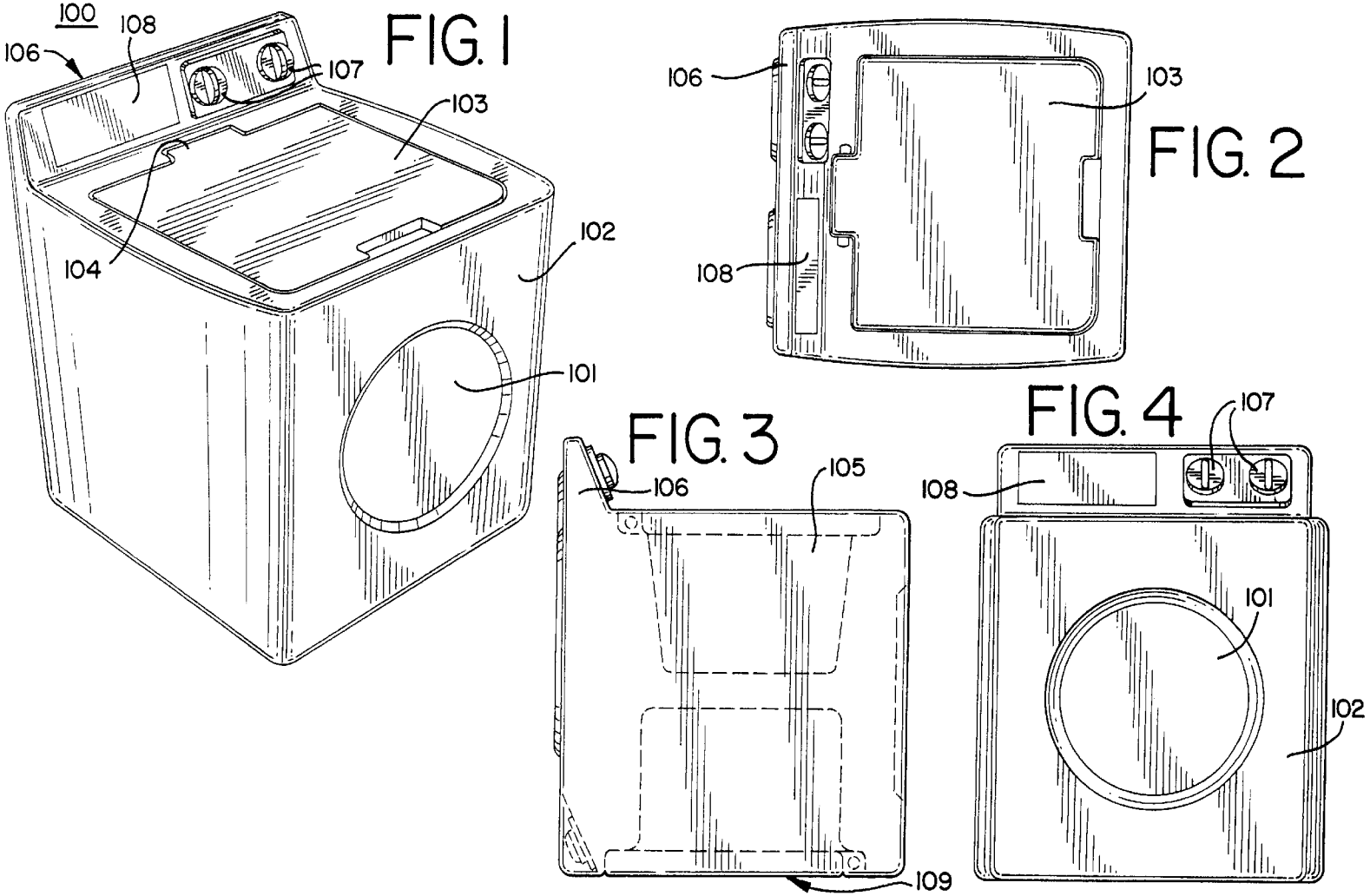
FIG. 1 is a left front perspective view of a toy of a first embodiment of the invention, showing a simulated washing machine environment.
FIG. 2 is a top plan view of the toy of FIG. I showing the simulated washing machine environment.
FIG. 3 is a left side elevational view of the toy of FIG. 1 showing the simulated washing machine environment.
FIG. 4 is a front elevational view of the toy of FIG. 1 showing the simulated washing machine environment.

FIGS. 1–9 are directed to a toy that has a washing machine environment when the toy is supported on one side and when the toy is flipped over to another side a stove/oven environment is displayed. Depicted in FIG. 1 is a washing machine environment 100. A simulated window 101 is displayed on the front side 102 that represents a window on the front of a washing machine and shows the foam and suds generally associated with a washing machine. The simulated window 101 is most easily accomplished by applying a decorative sticker or decal but could also be painted on the toy. On top of the toy is a door 103 that rotates about a hinge 104. When the door 103 is opened it reveals a recess 105 that represents the tub of the washing machine. Adjacent to the door 103 is a control panel 106. Control panel 106 simulates the control panel of a real washing machine. In a preferred embodiment, control panel 106 has knobs 107 to "control" the type of load and type of wash cycle. Additionally, a display 108, preferably a sticker or decal, can be added to represent the display of a washing machine that informs the user of the status of the cycle. The toy is supported by the base side 109.

A stove top environment is depicted in FIGS. 5–8. On the stove side 110 a pair of simulated burners 111 and a simulated grill 112 are provided. In each situation a sticker or decal is attached to the raised outline of the particular unit. The burners 111 and grill 112 could also be painted on the surface. Any pattern or arrangement of the burners 111 and grill 112 may be used. Alternatively, a simulated cutting board may replace the grill 112 or burners 111. A sticker or decal 113 may also be attached to the stove side 110 that depicts the lights generally associated with a stove top. The stove side 110 may also include, or be adjacent to, control knobs 114 that simulate the control knobs of a real stove.

Yet another environment is an oven, also depicted in FIG. 5. This environment is preferably, but not necessarily, provided in combination with the stove environment. An oven side 115 has an oven door 116 attached by a hinge 117. The door 116 opens to reveal a recess 118 that simulates the interior of an oven. The control knobs 114 simulate the control knobs of a real oven. The stove environment and the oven environment are displayed when the toy is supported on the base side 119.

Figure 9:
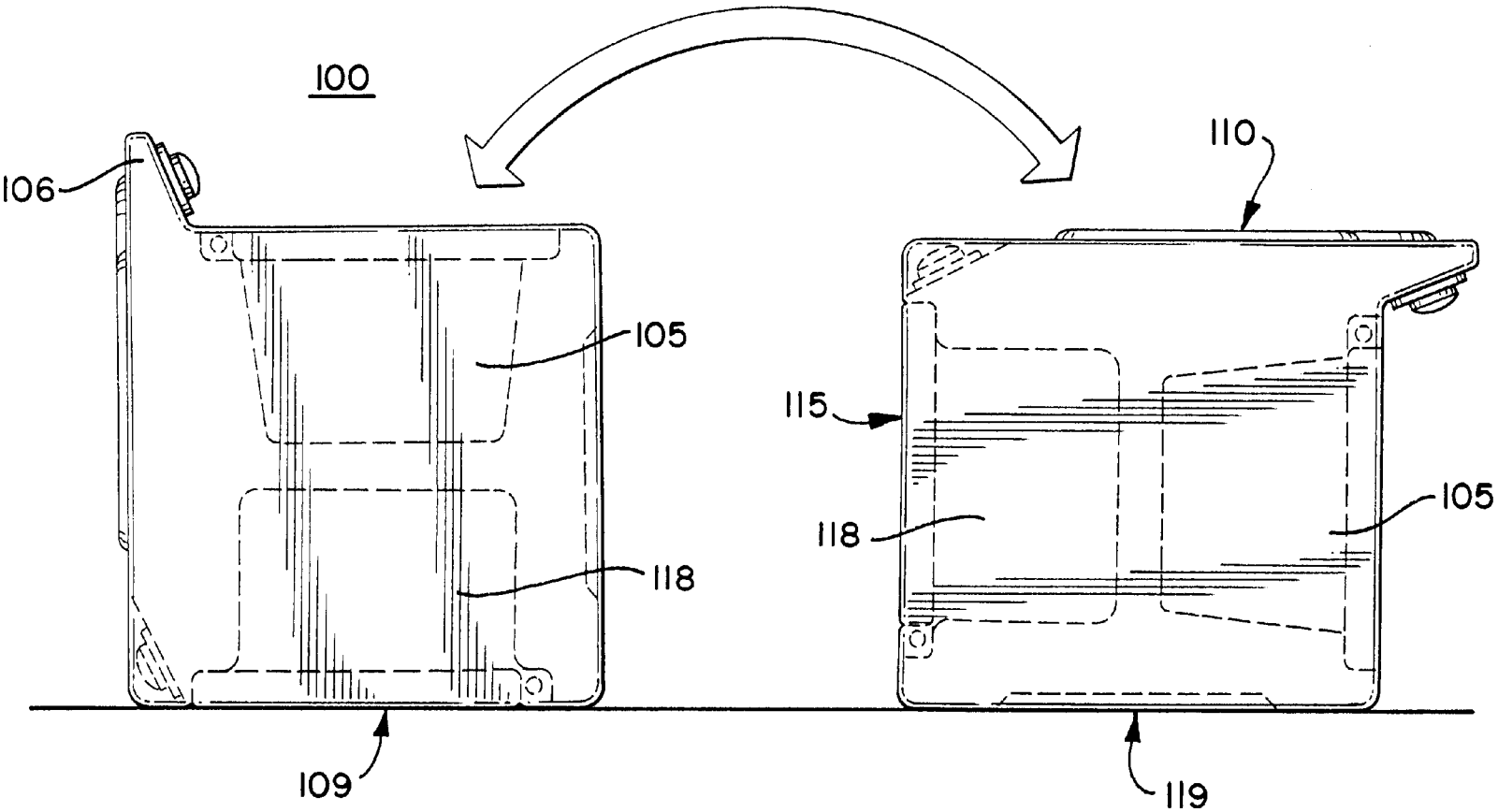
FIG. 9 is side view of the toy of FIG. 1 in its transition from a simulated washing machine environment to a simulated stove and oven environment.
Figure 16:
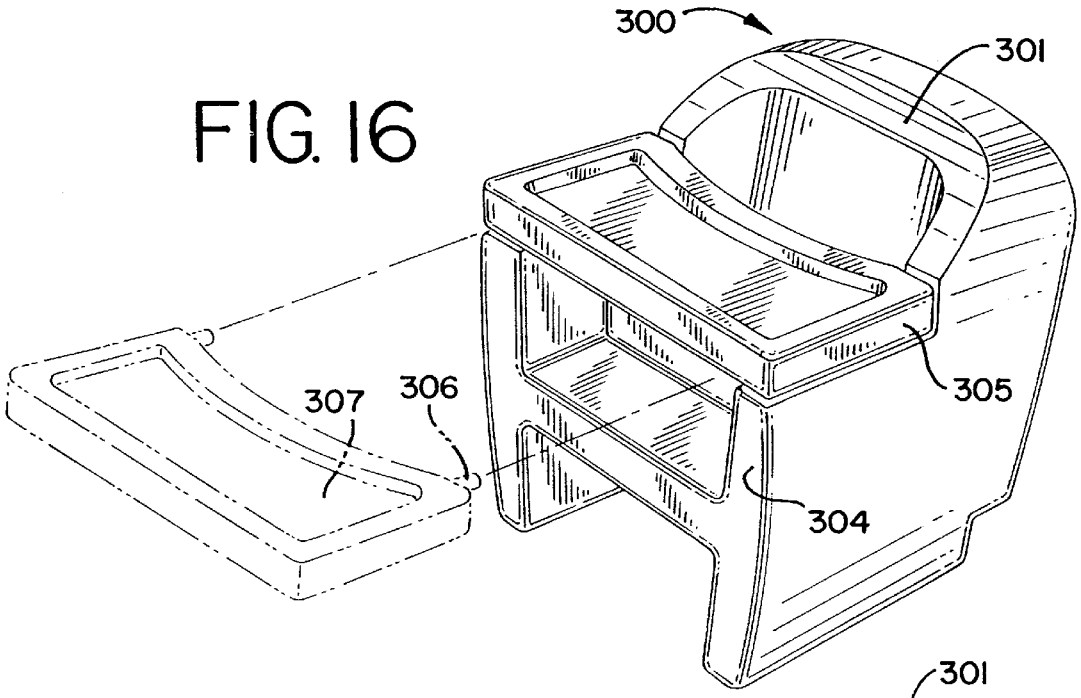
FIG. 16 is a right front perspective view of a toy of a third embodiment, showing an infant feeding chair and tray.
Figure 18:
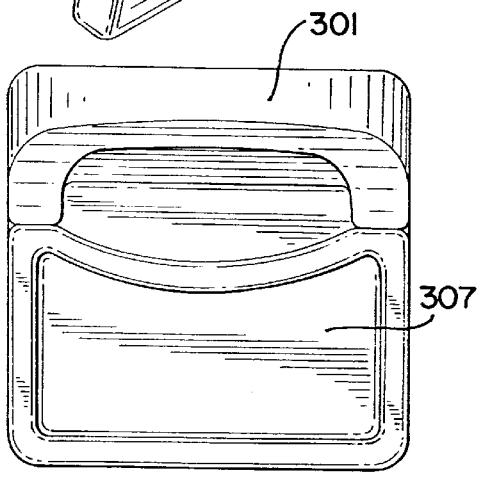
FIG. 18 is a top plan view of the toy of FIG. 16 showing the infant feeding chair and tray.
Figure 17:
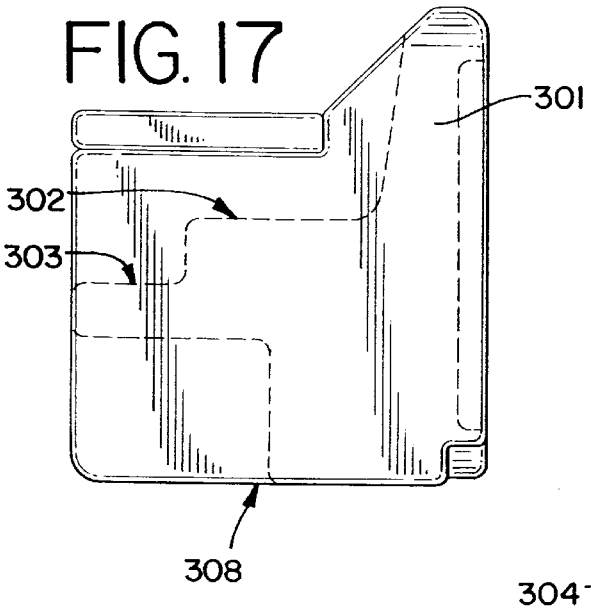
FIG. 17 is a right side elevational view of the toy of FIG. 16 showing the infant feeding chair and tray.
Figure 19:
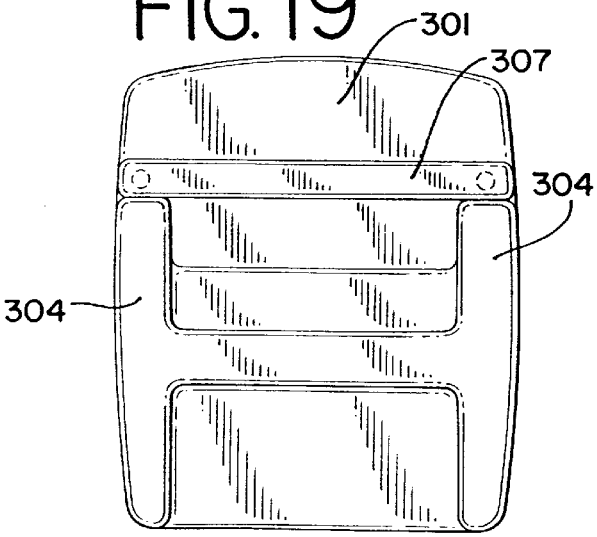
FIG. 19 is a front elevational view of the toy of FIG. 16 showing the infant feeding chair and tray.

FIGS. 1–9 depict the oven, stove and washing machine environments in a single toy. The washing machine environment may be easily converted to the oven/stove environment by rotating the toy 90-degrees as shown in FIG. 9.

FIGS. 10–15 are directed to a toy that displays an automatic teller machine environment. This toy can be easily flipped over to display a grocery check out lane environment. In FIGS. 10–12, an automatic teller machine is simulated. In this environment there is an interface side 200 and a safe side 201. The interface side 200 comprises a card receiver 202, a cash dispenser 203, a display 204, and a key pad 205, all of which are, of course, simulated. The card receiver 202 and the cash dispenser 203 consist of narrow slots 206. These slots represent, respectively, where the user inserts their bank card into the machine and where the machine dispenses cash. The display 204 may be a decal or sticker that depicts the computer display of an automatic teller machine. Display 204 could also be painted on the toy. Key pad 205 depicts the keys that control an automatic teller machine and, in the preferred embodiment, are slightly raised and integral with the toy. The safe side 201 has a door 207. On the door 207 is a decorative dial 208 that simulates the dial typically present on safes that permit the user to enter a combination and open a locked door. The door 207 swings on a hinge 209 to reveal recess 210 that represents the interior of the safe. This environment is displayed when the toy is supported on the base side 211.

Another environment is a grocery store check out lane, shown in FIGS. 13–15. The check out lane has a counter 220 upon which items may be placed and moved along to be "scanned" by the bar code scanner 221. The bar code scanner 221 is represented by a decal or sticker, or, alternatively, it may be painted on the toy. A register 222 is provided that consists of a keypad 223 and a display 224. Preferably, key pad 223 consists of slightly raised and integral keys and the display 224 is a decal or sticker. A candy display 225 is depicted with a decal or sticker that represents the racks of candy frequently seen at grocery store check out lanes. Also provided is a credit card scanner 226 consisting of keypad 227 and display 228, which are similar to the display 224 and key pad 223 of the register 222, and a scanning slot 229. The scanning slot 229 represents the slot through which one must run a credit card to pay for items. The grocery check out lane environment is displayed when the toy is supported by the base side 230.

FIGS. 10–15 depict the automatic teller machine environment and the grocery check out lane environment in a single toy. By rotating the toy 90-degrees, similar to FIG. 9, one may convert the toy from the grocery store check out lane to the automatic teller machine, and vice versa.

FIGS. 16–22 describe a third embodiment in which an infant feeding chair may be easily flipped over to provide a simulated infant changing table. Depicted in FIGS. 16–19 is an infant feeding chair 300. The chair 300 comprises a backrest 301, a seat 302, a step 303 and arms 304. In addition, a tray 305 may also be provided. Preferably, the tray 305 has pegs 306 that fit into corresponding holes in the backrest and secure the tray in the chair 300. The tray 305 has a recess 307 to prevent items from sliding off the tray and to contain spilled liquids. The step 303 and the seat 302 may combine to form a step stool as well. The chair 300 is supported by the base side 308.

Another environment is a table 310, particularly an infant changing table. The table 310 has a top surface 311 and, preferably, also has a tray 312. The table 310 is supported by base side 314. It is preferred for top surface 311 to be slightly recessed to prevent items from sliding off the top surface 311. Tray 312 may be, and preferably is, the reverse side of tray 305. In addition, tray 312 may have specific recesses 313. As with tray 305, tray 312 may have pegs 306 that fit into corresponding holes in the table 310 to secure the tray 312 to the table 310. The infant changing table 310 and the infant feeding chair 300 are particularly well suited for allowing a child to "feed" a doll in the infant feeding chair or changing the doll on a changing table.

FIGS. 16–22 depict the chair and the table in a single toy. The toy may be easily converted from the chair to the table by rotating the toy 90-degrees, and vice versa.

Each toy enables quick and easy conversion from one environment to another environment. The combinations detailed above are the most preferred embodiments and do not limit the various combinations possible. Any one of the environments suggested above could be combined with any other environment. Moreover, the particular environments suggested here are non-limiting examples and are preferred environments only.

The construction and composition of the toys of the present invention is not limited. It is preferable to use plastic injection molding technology. In the preferred embodiment the toys are constructed of polyethylene polymer, most preferably LLPED. One half of each toy is formed by injection molding LLPED and then joining the two halves to form a complete toy. However, the toys of the present invention could also be constructed of wood, foam, paperboard or any other suitable substance.

Of course, it should be understood that a wide range of changes and modifications can be made to the embodiments described above and depicted in the drawings. It is intended, therefore, that the foregoing description illustrates rather than limits this invention, and that it is the following claims, including all equivalents, that define this invention.

What is claimed is:

1. A toy comprising a simulated first environment, a simulated second environment, and a plurality of sides; the first environment and the second environment each being defined by at least one side; the first environment being displayed when the toy is supported on a first side; and the second environment being displayed when the toy is supported on a second side; wherein the first environment is an automatic teller machine environment and the second environment is a grocery check out lane.

2. A toy comprising a simulated first environment, a simulated second environment, and a plurality of sides; the first environment and the second environment each being defined by at least one side; the first environment being displayed when the toy is supported on a first side; and the second environment being displayed when the toy is supported on a second side; wherein the first environment is a washing machine environment and the second environment is a stove and oven environment.

3. A toy comprising a simulated first environment, a simulated second environment, and a plurality of sides; the first environment and the second environment each being defined by at least one side; the first environment being displayed when the toy is supported on a first side; and the second environment being displayed when the toy is supported on a second side; wherein the first environment is an infant feeding chair and the second environment is an infant changing table.

* * * * *